US005680002A

United States Patent [19]

Kunitomo et al.

[11] Patent Number: 5,680,002

[45] Date of Patent: Oct. 21, 1997

[54] MULTI-POLARITY TYPE SPARK PLUG FOR USE IN AN INTERNAL COMBUSTION ENGINE

[75] Inventors: Iwao Kunitomo; Yoshihiro Matsubara; Kozo Amano, all of Nagoya, Japan

[73] Assignee: NGK Spark Plug Co., Ltd., Nagoya, Japan

[21] Appl. No.: 592,693

[22] Filed: Jan. 26, 1996

[30] Foreign Application Priority Data

Feb. 9, 1995 [JP] Japan ..... 7-022096

[51] Int. Cl.[6] ..... H01T 13/20

[52] U.S. Cl. ..... 313/141

[58] Field of Search ..... 313/139, 141, 313/142, 140, 123

[56] References Cited

U.S. PATENT DOCUMENTS 3,870,918 3/1975 Senda et al. ..... 313/141
4,275,328 6/1981 Watanabe et al. ..... 313/123

FOREIGN PATENT DOCUMENTS 4230447 3/1994 Germany ..... H01T 13/20
52-15739 5/1977 Japan ..... H01T 13/32
59-29358 8/1984 Japan ..... H01T 13/32

*Primary Examiner*—Sandra L. O'Shea
*Assistant Examiner*—Vip Patel
*Attorney, Agent, or Firm*—Sughrue, Mion, Zinn, Macpeak and Seas

[57] ABSTRACT

In a multi-polarity type spark plug for an internal combustion engine, a tubular insulator is supported within a cylindrical metallic shell through which a spark plug is to be attached to an internal combustion engine. A center electrode is placed within the insulator, a front end of the center electrode being directed toward a combustion chamber of the internal combustion engine from a front end of the metallic shell so as to extend beyond a front end of the insulator. First and second ground electrodes are each connected to the front end of the metallic shell, the first ground electrode forming a first vertical spark gap with a front end surface of the center electrode which directly opposes an elevational side of the center electrode, and the second ground electrode forming a second horizontal spark gap with an elevational side of the center electrode. An angle θa is limited as $60° \leqq \theta a \leqq 150°$ in which the angle θa is taken when the first ground electrode forms against the second ground electrode with the center electrode as an axial center.

4 Claims, 20 Drawing Sheets

MULTI-POLARITY TYPE SPARK PLUG FOR USE IN AN INTERNAL COMBUSTION ENGINE

BACKGROUND OF THE INVENTION

1. [Field of the Invention]

This invention relates to a multi-polarity type spark plug for use in an internal combustion engine in which two or three ground electrodes are disposed around a front end of a center electrode in order to improve ignitability.

2. [Description of Prior Art]

With the recent requirement of an enhanced fuel efficiency and purified emission for an internal combustion engine, there is a demand to run an automobile engine with rarefied fuel gas. In order to cope with the demand, a burning method has been adopted to facilitate movement of an air-gas fuel mixture within a combustion chamber of the internal combustion engine by making use of swirl currents so as to compensate the flame propagation of the air-gas fuel mixture itself. Upon adopting this type of burning method, it is necessary to positively ignite streams of lean fuel gas (having a greater air-to-fuel ratio) which quickly run across the spark plug disposed to extend interior from a wall of the combustion chamber. An experimental test was carried out to check an ignitability on various spark plugs which have been used hitherto.

FIG. 17*a*, 17*b* show a dual polarity type spark plug (referred to as "a first prior art") to represent a general multi-polarity spark plug. In the first prior art, two ground electrodes 102, 103 are turned into L-shaped configuration, and arranged to diametrically oppose each other around a center electrode 101 so as to form a spark gap with an elevational side of the center electrode 101. In this instance, the two ground electrodes 102, 103 are each connected to a front end of a cylindrical metallic shell 104 by means of welding or the like with an angular interval of 180 degrees with the center electrode 101 as an axial center.

FIG. 18 shows another type of dual-polarity type spark plug (referred to as "a second prior art") to exemplify a multi-polarity type spark plug. In the second prior art disclosed in Japanese Utility Model Publication No. 59-29358, two ground electrodes 102, 103 are turned in to L-shaped configuration, and arranged to form a spark gap with an elevational side of a center electrode 101. In this instance, the two ground electrodes 102, 103 disposed around a center electrode 101 with an angular interval other than 180 degrees. Namely, the two ground electrodes 102, 103 are connected to a front end of a cylindrical metallic shell 104 by means of welding or the like with an angular interval less than 180 degrees with the center electrode 101 as an axial center.

In the first prior art in which the two ground electrodes 102, 103 are oriented to make a right angle with streams of an air-fuel mixture within a combustion chamber of an internal combustion engine as shown in FIG. 17*a*, an entry of the streams of an air-fuel mixture into the spark gap is facilitated by smoothly introducing the streams into a spark discharge path formed between a front end surface of the center electrode 101 and the elevational side of the two electrodes 102, 103. This readily improves an ignitability against the streams of the air-fuel mixture. Additionally, the ignitability is significantly improved with less flame-extinguishing effect (cooling effect) due to an absence of the outer electrodes 102, 103 in a direction in which flames appeared across the spark gap spread and disseminate. This is exemplified by a graph A in FIG. 19.

However, in the first prior art in which the two ground electrodes 102, 103 are oriented to be parallel with the streams of the air-fuel mixture as shown in FIG. 17*b*, an entry of the streams of an air-fuel mixture into the spark gap is somewhat sacrificed. This worsens the ignitability against the streams of the air-fuel mixture. Additionally, the ignitability is significantly reduced under the influence of the flame-extinguishing effect due to the air-fuel mixture streams running along the ground electrodes 102, 103 which are located to interpose the center electrode 101, and oriented in such a direction as the flames spread and disseminate. This is exemplified by a graph B in FIG. 19.

As exemplified by the graphs in FIG. 19 which shows a relationship between number of misfires (times) and air-to-fuel ratio (A/F), it is found that the ignitability is profoundly affected depending on the direction in which the ground electrodes 102, 103 are oriented against the air-fuel mixture streams. This is to say, a degree of the ignitability greatly depends on the directional difference in which the two ground electrodes 102, 103 are oriented.

In the second prior art, an ignitable limit air-to-fuel ratio (A/F) was checked by changing a directional angle (θ) of one ground electrode 103 with the other ground electrode 102 oriented in such a direction as to extremely worsen the ignitability against the air-fuel mixture streams. The results are shown by FIG. 20 which indicates that the ignitability deteriorates abruptly when the ground electrode 103 nears the other ground electrode 102 to such an extent that the directional angle (θ) is less than 60°. FIG. 20 also shows that the ignitability deteriorates sharply when the ground electrode 103 is away from the other ground electrode 102 to such an extent that the directional angle (θ) exceeds 150° toward 180°.

In the first and second prior arts, the spark discharge path is only oriented along the radial direction of the center electrode 101 from the center electrode 101 to the two ground electrodes 102, 103. For this reason, the air-fuel mixture streams is not likely exposed to the spark discharge path effectively so as to make the ignitability unstable when the air-fuel mixture streams run along the radial direction (horizontally) of the center electrode 101.

As a consequence, it is necessary to decrease an ignitability variation depending on directional difference of the ground electrodes 102, 103 against the air-fuel mixture streams since the air-fuel mixture streams are ever changing its direction within the combustion chamber of the internal combustion engine.

Therefore, it is one of the objects of the invention to provide a multi-polarity type spark plug for an internal combustion engine which is capable of reducing the ignitability variation regardless of which direction the ground electrodes are oriented against the air-fuel mixture streams within the combustion chamber of the internal combustion engine.

It is another object of the invention to provide a multi-polarity type spark plug for an internal combustion engine which is capable of effectively exposing the air-fuel mixture streams to the spark discharge path so as to attain the stable ignitability irrespective of whether the air-fuel mixture streams are running in a horizontal direction or vertical direction.

SUMMARY OF THE INVENTION

According to the present invention, there is provided a multi-polarity type spark plug comprising: a tubular insulator supported within a cylindrical metallic shell through which a spark plug is to be attached to an internal combustion engine; a center electrode placed within the insulator, a front end of the center electrode being directed toward a combustion chamber of the internal combustion engine from a front end of the metallic shell so as to extend beyond a front end of the insulator; first and second ground electrodes each connected to the front end of the metallic shell, the first ground electrode forming a first spark gap with a front end surface of the center electrode, and the second ground electrode forming a second spark gap with an elevational side of the center electrode; an angle θa being limited as $60° \leqq \theta a \leqq 150°$, wherein θa is an angle in which the first ground electrode forms against the second ground electrode with the center electrode as an axial center.

In this situation, the angle θa may be limited as $90° \leqq \theta a \leqq 150°$. The angle θa may be preferably defined as $110° \leqq \theta a \leqq 130°$. It is more preferable that the angle θa is defined to be 120°.

According to another aspect of the invention, the front end surface of the second ground electrode serves as a firing portion which forms the second spark gap with the elevational side of the center electrode, and which is a flat-shaped configuration.

According to still another aspect of the invention, a third ground electrode is provided whose front end forms a third spark gap with the elevational side of the center electrode, and an angular relationship among θa, θb and θc is limited as $60° \leqq \theta a \leqq 150°$, $60° \leqq \theta b \leqq 150°$, $60° \leqq \theta c \leqq 150°$ and $\theta a + \theta b + \theta c = 360°$, wherein θb is an angle in which the second ground electrode forms against the third ground electrode with the center electrode as an axial center, and θc is an angle in which the third ground electrode forms against the first ground electrode with the center electrode as an axial center.

In this instance, the angular relationship among θa, θb and θc may be limited as $90° \leqq \theta a \leqq 150°$, $90° \leqq \theta b \leqq 150°$, $90° \leqq \theta c \leqq 150°$. The angular relationship may be preferably defined to $110° \leqq \theta a \leqq 130°$, $110° \leqq \theta b \leqq 130°$, $110° \leqq \theta c \leqq 130°$. It is more preferable that the angular relationship may be limited as $\theta a = \theta b = \theta c$ 120°.

According to other aspect of the invention, front end surfaces of both the second and third ground electrodes serve as a firing portion which forms the second and third spark gaps with the elevationel sides of the center electrode, and which are a flat-shaped configuration.

With the angular relationship as arranged, it is possible to prevent the ignitability from deteriorating when the first ground electrode is directed horizontally along the air-fuel mixture streams within the combustion chamber of the internal combustion engine. The first ground electrode is unlikely to contact flames so as not to give the flame-extinguishing effect (cooling effect) to prevent the ignitability from further deteriorating.

When the second ground electrode is oriented in a direction parallel with the air-fuel mixture streams within the combustion chamber of the internal combustion engine, it is possible to prevent the ignitability from deteriorating. The second ground electrode is unlikely to contact flames so as not to give the flame-extinguishing effect (cooling effect) to prevent the ignitability from further deteriorating.

When the air-fuel mixture streams is oriented in the radial direction of the center electrode (horizontally) within the combustion chamber of the internal combustion engine, it is possible that the air-fuel mixture streams is effectively exposed to a vertical spark discharge path spanning from the front end surface of the center electrode to the first ground electrode. When the air-fuel mixture streams is oriented in the axial direction of the center electrode (vertically) within the combustion chamber of the internal combustion engine, it is possible that the air-fuel mixture streams is effectively exposed to a lateral spark discharge path spanning from the elevational side of the center electrode to the second ground electrode.

With the third ground electrode being further provided, it is possible to prevent the ignitability from further deteriorating upon the entry of the air-fuel mixture streams into the combustion chamber of the internal combustion engine.

In brief, it is possible to substantially eliminate the ignitability variation since the angular relationship enables to avoid a deterioration of the air-fuel mixture to be ignited, and at the same time, preventing an extreme deterioration of the ignitability and a reduction of an ameliorated ignitability effect. Since it is possible to effectively expose the air-fuel mixture to at least any one of plurality spark discharge paths irrespective of whether the air-fuel mixture streams are running vertically or horizontally.

BRIEF DESCRIPTION OF THE DRAWINGS

These and other objects, aspect and embodiments of the invention will be described in more detail with reference to the following drawing figures, of which.

DETAILED DESCRIPTION OF PREFERRED EMBODIMENTS OF THE INVENTION

The embodiments of the invention according to the multi-polarity type spark plug for use in an internal combustion engine is described below in reference to the drawings.

Figure 1:
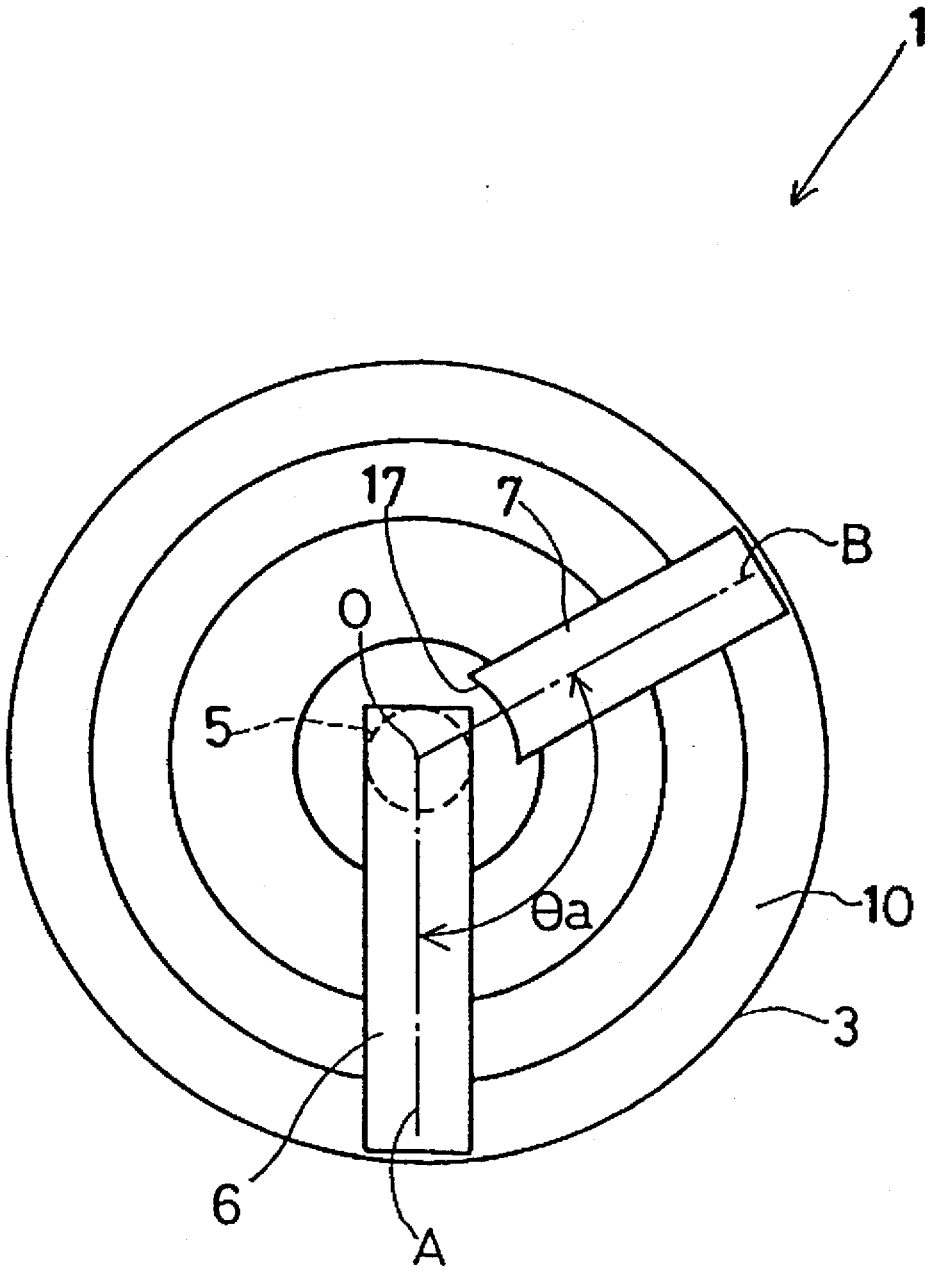
FIG. 1 is a plan view of a firing portion of a multi-polarity type spark plug according to a first embodiment of the invention.
Figure 2:
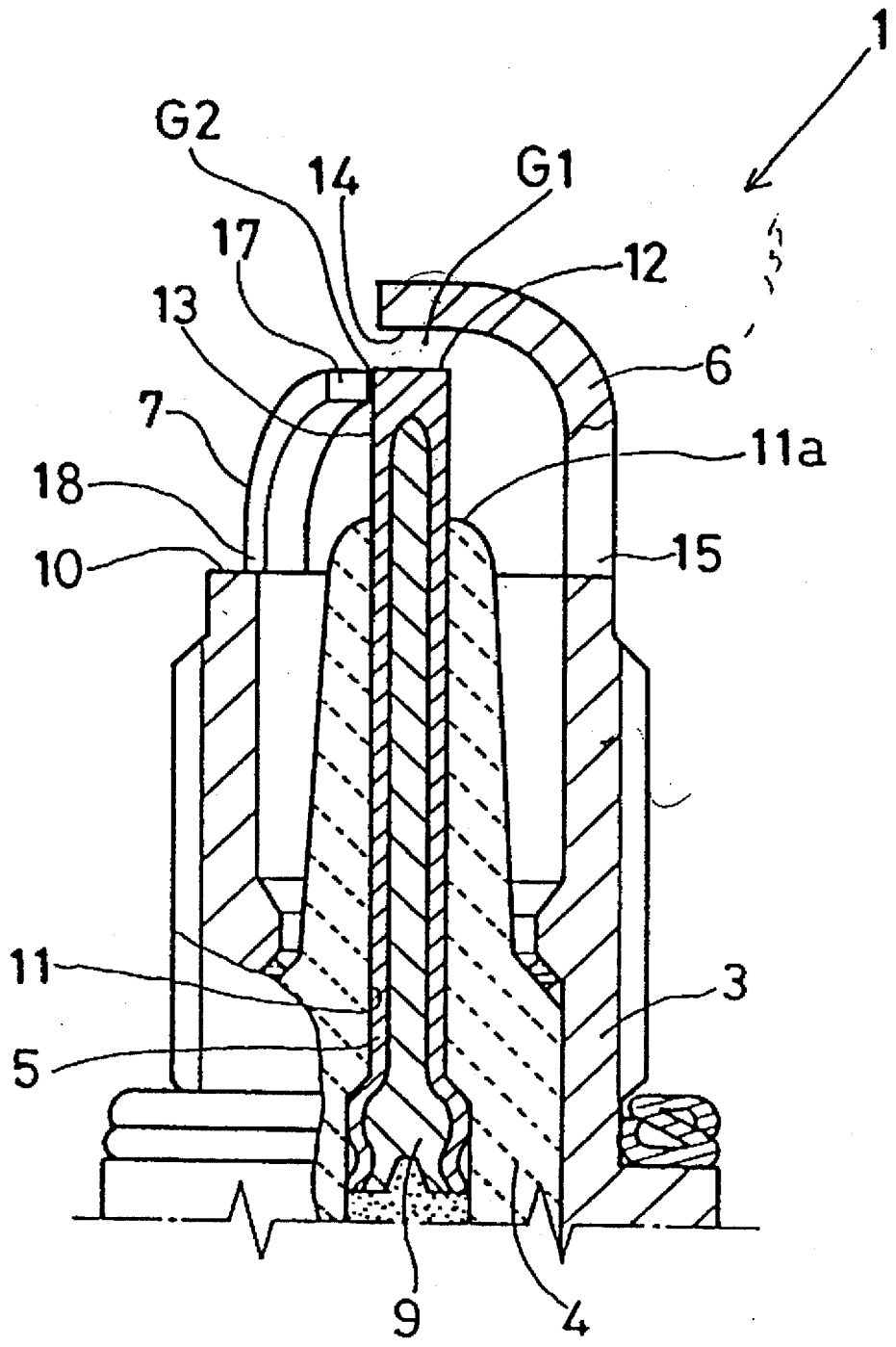
FIG. 2 is a longitudinal cross sectional view of a main part of the multi-polarity type spark plug.

Referring to FIGS. 1 through 10 which show a first embodiment of the invention. FIG. 1 is a plan view of a firing portion of a prod-type spark plug 1 of dual-polarity which is to be mounted on a cylinder head of a gasoline engine. FIG. 2 is a longitudinal cross sectional view of a main portion of the dual-polarity type spark plug.

The dual-polarity type spark plug 1 has a cylindrical metallic shell 3 and a tubular insulator 4 which is supported within the metallic shell 3. Within the insulator, a bar-like center electrode 5 is concentrically provided. First and second ground electrodes 6, 7 are provided around the center electrode 5 to form a spark gap (spark discharge gap and air gap) with a front portion of the center electrode 5.

The metallic shell 3 is made of a electrically conductive low-carbon steel to serve as a mount metal (housing) through which the dual-polarity type spark plug 1 is mounted on the cylinder head of the gasoline engine. To a front end 10 of the metallic shell 3, the first and second ground electrodes 6, 7 are connected by means of welding or the like. The insulator 4 is made of a sintered ceramics with alumina ($Al_2O_3$) as a main ingredient. An inner space of the insulator 4 serves as an axial bore 11 in which the center electrode 5 is firmly supported.

The center electrode 5 forms a composite structure having a clad metal and a core 9 embedded in the clad metal. The clad metal is made of an erosion-and heat-resistant nickel alloy (e.g. Ni—Si—Mn—Cr alloy, Inconel 600), and the core 9 made of a heat-conductive copper or copper based alloy. A cross sectional shape of the center electrode 5 is circular whose the front portion extends beyond a front end 11*a* of the insulator 4.

The front portion of the center electrode 5 extends by e.g. 1.5~9.5 mm beyond the front end 10 of the metallic shell 3. Such is the extension of the center electrode 5 that the front portion of the center electrode 5 extends by 4.5~17.0 mm from a wall of the combustion chamber toward a center of the combustion chamber when the dual-polarity type spark plug 1 is mounted on the cylinder head of the gasoline engine. A front end surface 12 of the center electrode 5 opposes a front end of the first ground electrode 6. A front end surface 17 of the second ground electrode 7 is in opposition with an elevational side 13 of the center electrode 5.

The first ground electrode 6 represents one ground electrode among a plurality of ground electrodes, and made of an erosion-and heat-resistant nickel alloy Ni—Si—Mn—Cr alloy, Inconel 600) which forms an electrically conductive structure. The first ground electrode 6 is rectangular in cross section, and turned into L-shaped configuration. The first ground electrode 6 serves its front end surface 14 as a firing end portion which opposes the front end surface 12 of the center electrode 5, and at the same time, having a connection end 15 through which the first ground electrode 6 is connected to the front end 10 of the metallic shell 3.

Between the firing end 14 of the first ground electrode 6 and the front end surface 12 of the center electrode 5, a spark gap G1 is provided. Across the spark gap G1, a first spark discharge path H1 is defined from the front end surface 12 of the center electrode 5 to the firing end 14 of the first ground electrode 6. The first spark discharge path H1 is oriented in a vertical (up-and-down) direction.

The second ground electrode 7 represents the other ground electrode among a plurality of the ground electrodes, and made of the same electrically conductive metal as the first ground electrode 6. The second ground electrode 7 is rectangular in cross section, and turned substantially into L-shaped configuration. The lengthwise dimension of the second ground electrode 7 is shorter than that of the first ground electrode 6. The second ground electrode 7 further has the front end surface 17 to serve as a firing end which opposes the elevational side 13 of the center electrode 5. The second ground electrode 7 also has a connection end 18 through which the second ground electrode 7 is connected to the front end 10 of the metallic shell 3.

The firing end 17 of the second ground electrode 7 is defined to curve along an outer circumferential surface of the center electrode 5 so as to be in concentrical relationship with an axis of the center electrode 5. The connection end 18 of the second ground electrode 7 makes a certain angle (e.g. 120°) with the connection end 15 of the first ground electrode 6.

Between the firing end 17 of the second ground electrode 7 and the elevational side 13 of the center electrode 5, a spark gap G2 is provided. Across the spark gap G1, a second spark discharge path H2 is defined from the elevational side 13 of the center electrode 5 to the firing end 17 of the second ground electrode 7. The second spark discharge path H2 is oriented in a radial (lateral or horizontal) direction of the center electrode 5.

With the axis of the center electrode 5 as a center, the first ground electrode 6 forms an angle (θa) with the second ground electrode 7 as designated by notations A and B in FIG. 1. That is to say, the first and second ground electrodes 6, 7 are arranged with a certain angular interval (θa) as defined by the following formula.

$$60° \leqq \theta a \leqq 150°$$

The angle (θa=<AOB) is obtained by an angle in which a phantom line A forms with a phantom line B. The former line A is obtained by connecting a central line of the first ground electrode 8 and a center 0 of the center electrode 5, while the latter line B is obtained by connecting the second ground electrode 7 and the center 0 of the center electrode 5.

Experimental tests were carried out to check how an ignitability is affected by changing directions of the first and second ground electrodes 6, 7 with the axis of the center electrode 5 as a central portion. Upon carrying out the experimental test, minutiae of the multi-polarity type spark plug is defined as follows:

A diameter of the center electrode 5 measures 2.5 mm, the spark gaps measures 1.0 mm between the center electrode 5 and the first and second ground electrodes 6, 7. The extension length of the center electrode 5 measures 3.0 mm, and the dimension of the first and second ground electrodes 6, 7 is 1.3 mm×2.7 mm.

Upon carrying out first and second experimental tests, an ignitable limit air-to-fuel ratio is checked by running 60 km with the multi-polarity type spark plug (FIGS. 1 and 2) mounted on a 6-cylinder, 2000 cc, lean burn gasoline engine.

Figure 3A:
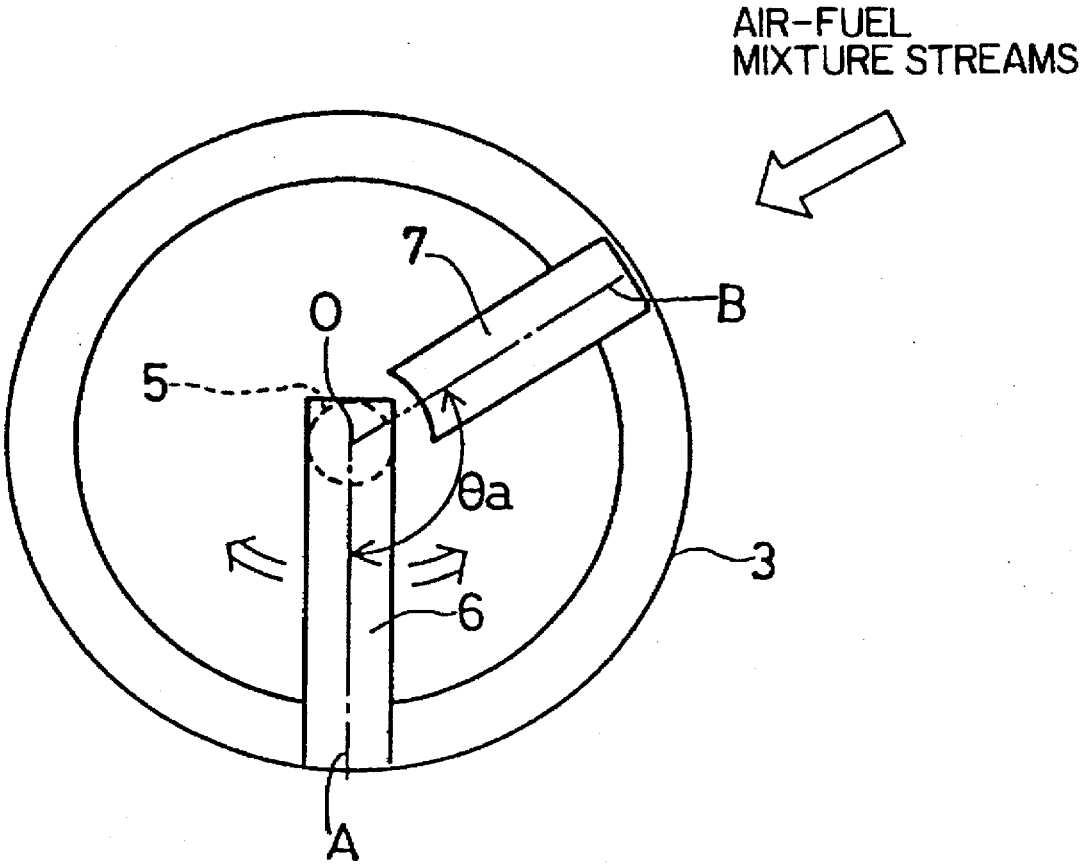
FIG. 3*a* is an explanatory view showing a relationship between an air-fuel mixture streams and directions of first and second ground electrode in a first experimental test.
Figure 3B:
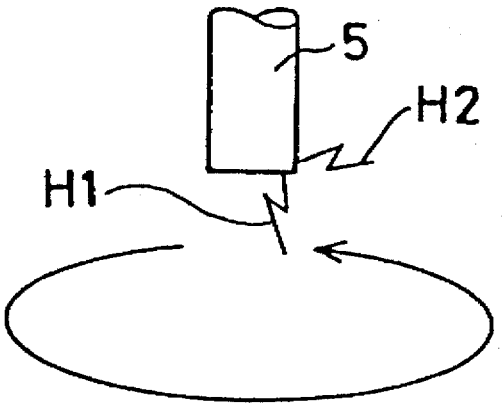
FIG. 3*b* is an explanatory view showing the air-fuel mixture streams within a combustion chamber of an internal combustion engine in the first experimental test.

In the first experimental test, the second ground electrode 7 is oriented such as to worsen the ignitability in relation with the air-fuel streams running horizontally as already shown in FIGS. 3*a* and 3*b* . In this situation, the ignitable limit air-to-fuel ratio (A/F) was checked by changing the directional angle (θa) in which the first ground electrode 6 forms with the second ground electrode 7 from 30° to 180°. The results are shown in FIG. 4.

Figure 4:
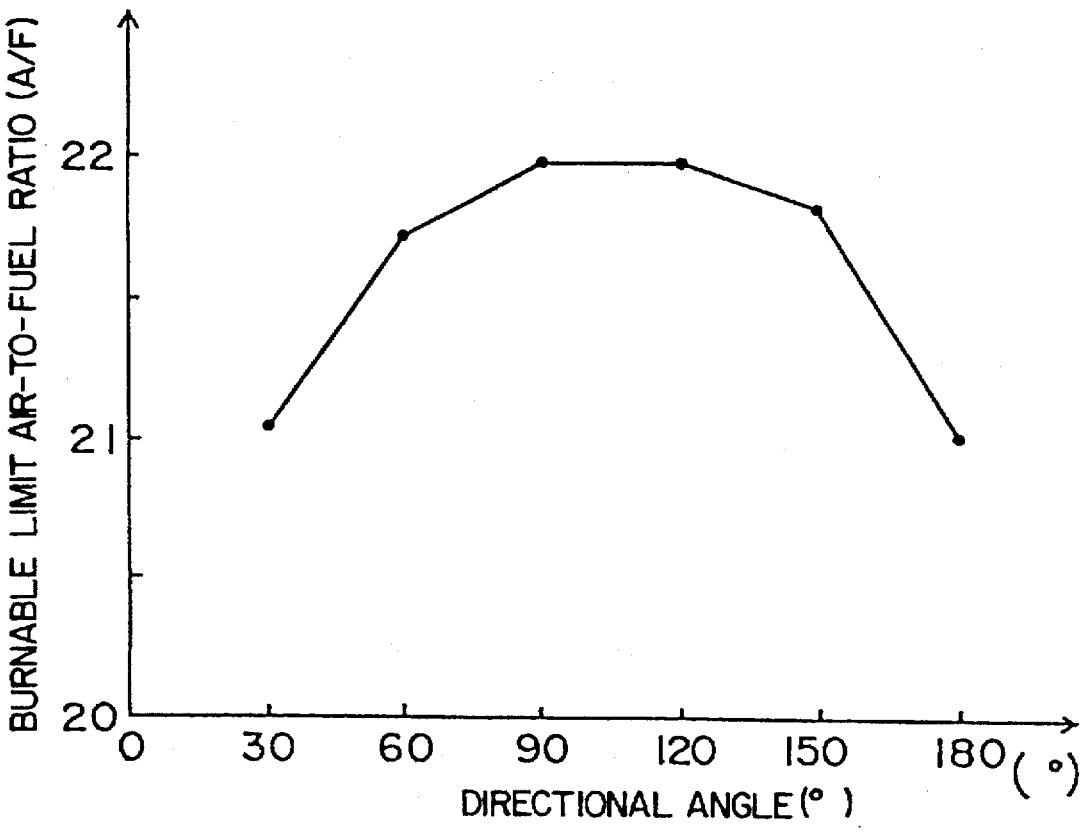
FIG. 4 is a graph showing a relationship between a burnable limit air-to-fuel ratio (A/F) and an angle in which the first ground electrode forms with the second ground electrode in the first experimental test.

As apparent from FIG. 4, the ignitability tends to abruptly worsen when the first ground electrode 6 nears the second ground electrode 7 so that the angle (θa) is less than 60°.

As apparent from FIG. 4, the ignitability tends to abruptly worsen when the first ground electrode 6 nears the second ground electrode 7 so that the angle (θa) is less than 60°. The ignitability also tends to abruptly worsens when the first ground electrode 6 is oriented away from the second ground electrode 7 so that the angle (θa) exceeds 150° toward 180°. To summarize the results, the ignitability tends to be improved when the directional angle (θa) is from 60° to 150°, and the ignitability is preferably improved particularly when the directional angle (θa) ranges from 90° to 120°.

Figure 5A:
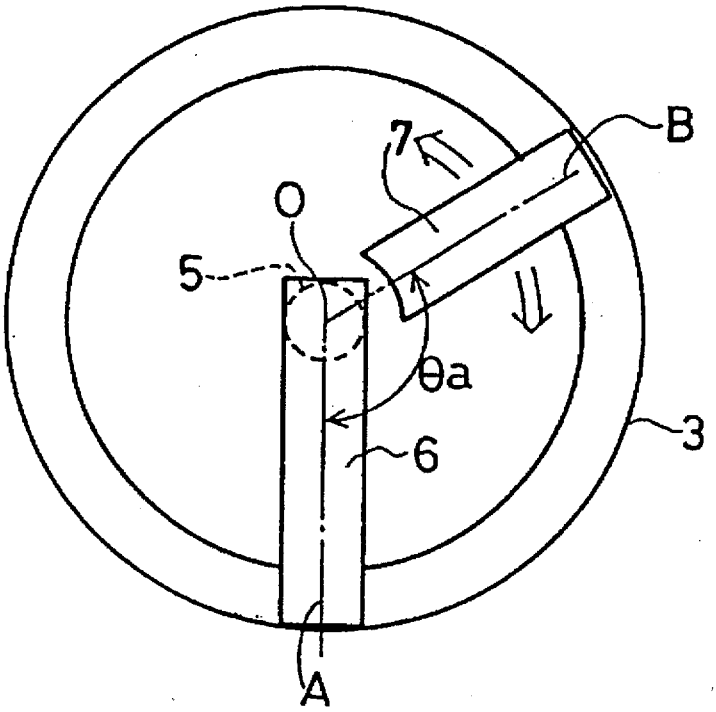
FIG. 5*a* is an explanatory view showing a relationship between an air-fuel mixture streams and directions of first and second ground electrode in a second experimental test.
Figure 5B:
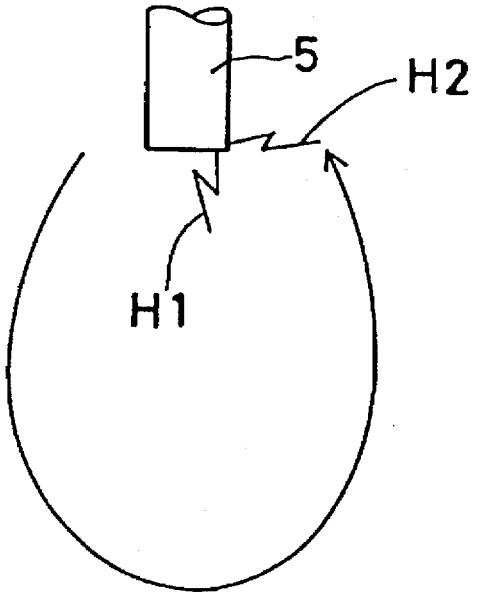
FIG. 5*b* is an explanatory view showing the air-fuel mixture streams within a combustion chamber of an internal combustion engine in the second experimental test.

In the second experimental test, the first ground electrode 6 is oriented such as to worsen the ignitability in relation with the air-fuel streams running vertically as already shown in FIGS. 5*a* and 5*b*. In this situation, the ignitable limit air-to-fuel ratio (A/F) was checked by changing the directional angle (θa) in which the second ground electrode 7 forms with the first ground electrode 6 from 30° to 180°. The results are shown in FIG. 6.

Figure 6:
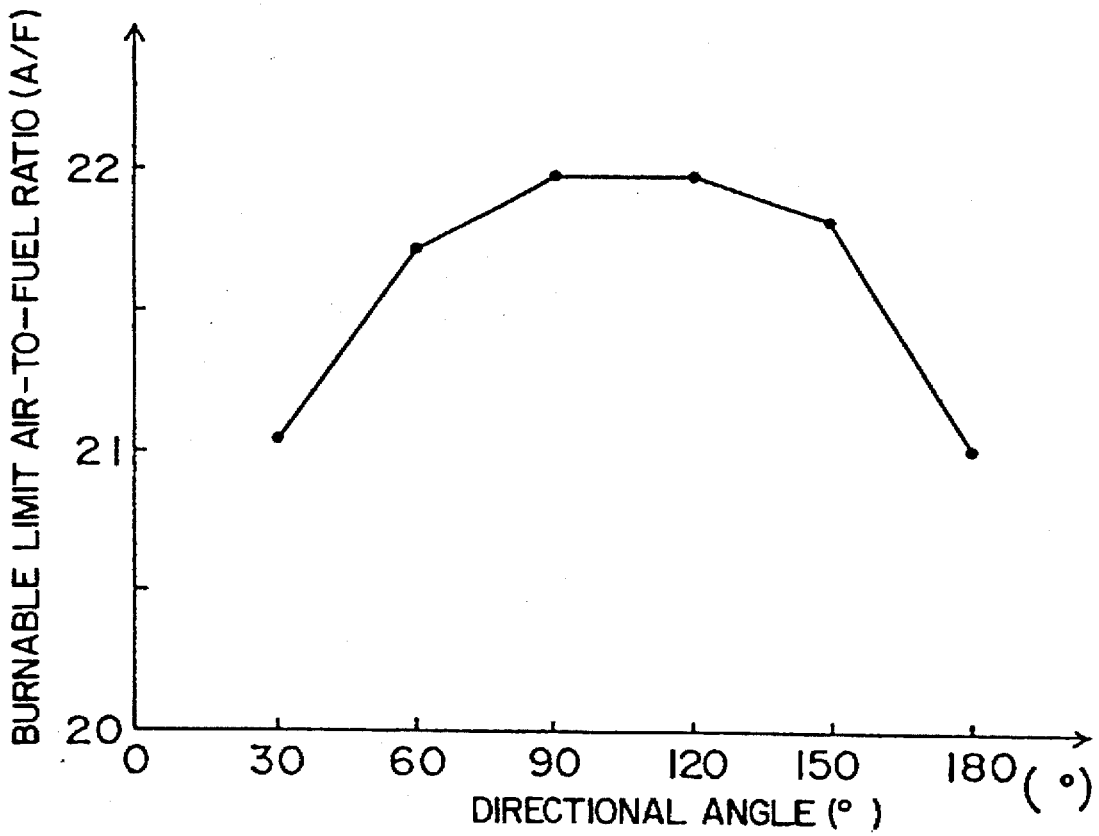
FIG. 6 is a graph showing a relationship between a burnable limit air-to-fuel ratio (A/F) and an angle in which the first ground electrode forms with the second ground electrode in the second experimental test.

It is found from the FIG. 6 that the ignitability tends to be improved when the directional angle (θa) is from 60° to 150° in the same manner as indicated by FIG. 4.

When the first ground electrode 6 is oriented such a direction (horizontal) as to worsen the ignitability in relation with the air-fuel mixture streams (referred to as "swirl"), the direction of the swirl makes a certain angle with that of the spark discharge path H2 which leads the elevational side 13 of the center electrode 5 to the firing end 17 of the second ground electrode 7. This makes it possible to prevent the ignitability from deteriorating. The first ground electrode 6 is positioned somewhat away from a direction in which the flames spread and disseminate from the spark gap G2 between the elevational side 13 of the center electrode 5 and the firing end 17 of the second ground electrode 7. This prevents the first ground electrode 6 from being directly exposed to the flames so that the cooling effect is alleviated under the least flame-extinguishing effect so as to prevent the ignitability from extremely deteriorating.

In a similar way, when the second ground electrode 7 is oriented such a direction (horizontal) as to worsen the ignitability in relation with the air-fuel mixture streams (swirl), the direction of the swirl generally makes a right angle with that of the spark discharge path H1 which leads the front end surface 12 of the center electrode 5 to the firing end 14 of the first ground electrode 6. This makes it possible to prevent the ignitability from deteriorating. The second ground electrode 7 is positioned somewhat away from a direction in which the flames spread and disseminate from the spark gap G1 between the front end surface 12 of the center electrode 5 and the firing end 14 of the first ground electrode 6. This prevents the second ground electrode 7 from being directly exposed to the flames so that the cooling effect is alleviated under the least flame-extinguishing effect so as to prevent the ignitability from extremely deteriorating.

Figure 7A:
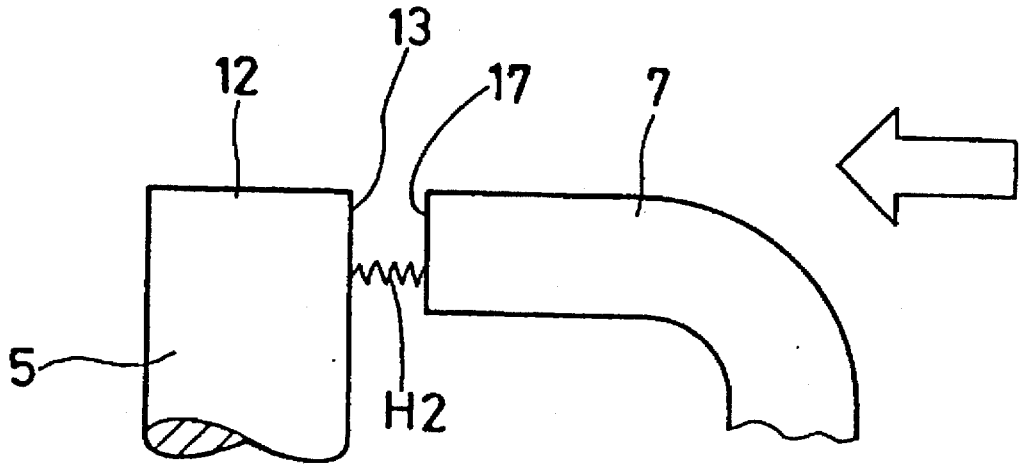
FIG. 7*a* is an explanatory view showing a relationship between the second ground electrode and a swirl current.
Figure 7B:
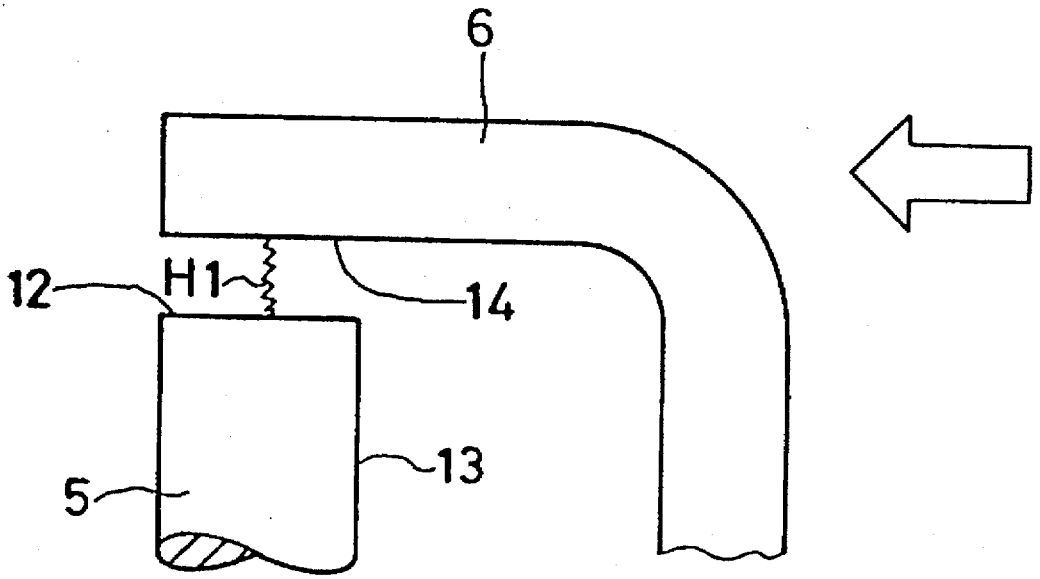
FIG. 7*b* is an explanatory view showing a relationship between the first ground electrode and a swirl current.

In the case in which the swirl travels in the radial direction of the center electrode 5 (horizontally or laterally), namely the swirl runs in the same direction as the spark discharge path H2 is oriented along a direction from the elevational side 13 of the center electrode 5 to the firing end 17 of the second ground electrode 7 as shown in FIG. 7*a*, the spark discharge path H1 is exposed effectively to the swirl since the path H1 is vertically oriented from the front end surface 12 of the center electrode 5 to the firing end 14 of the first ground electrode 6 as shown in FIG. 7*b*.

Figure 8A:
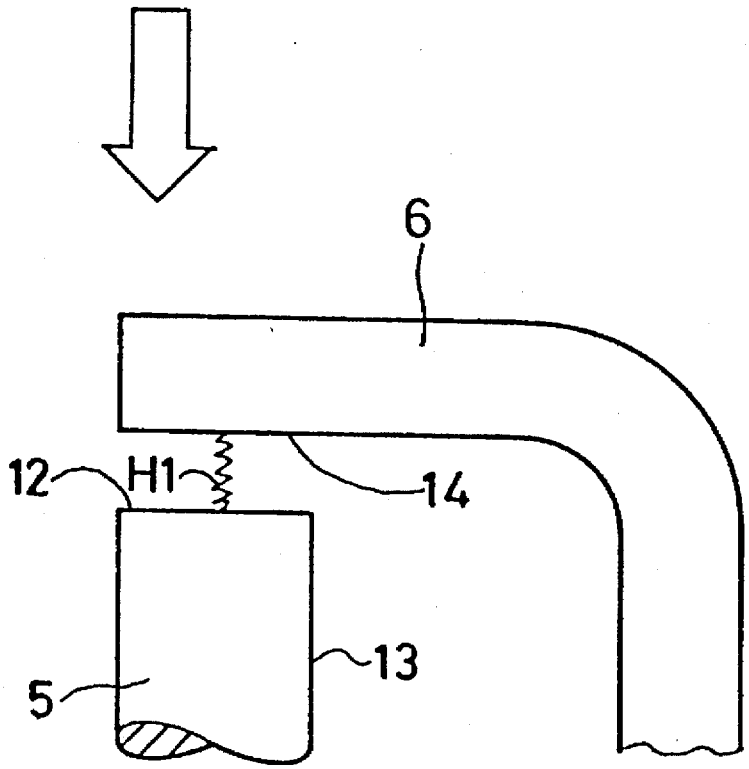
FIG. 8*a* is an explanatory view showing a relationship between the first ground electrode and a swirl current.
Figure 8B:
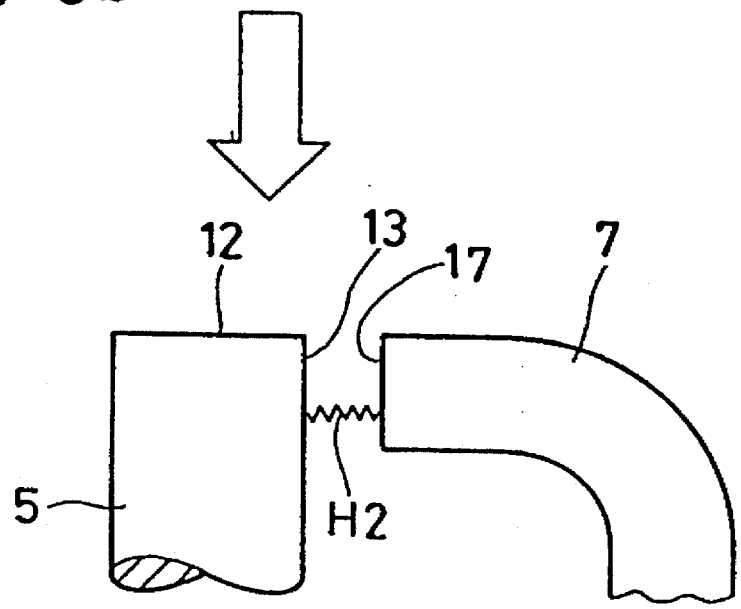
FIG. 8*b* is an explanatory view showing a relationship between the second ground electrode and a swirl current.

In the case in which the swirl travels in the axial direction of the center electrode 5 (vertically or longitudinally), namely the swirl runs in the same direction as the spark discharge path H1 is oriented along a direction from the front end surface 12 of the center electrode 5 to the firing end 14 of the first ground electrode 6 as shown in FIG. 8*a*, the spark discharge path H2 is exposed effectively to the swirl due to the path H2 laterally oriented from the elevational side 13 of the center electrode 5 to the firing end 17 of the second ground electrode 7 as shown in FIG. 8*b*.

Figure 9:
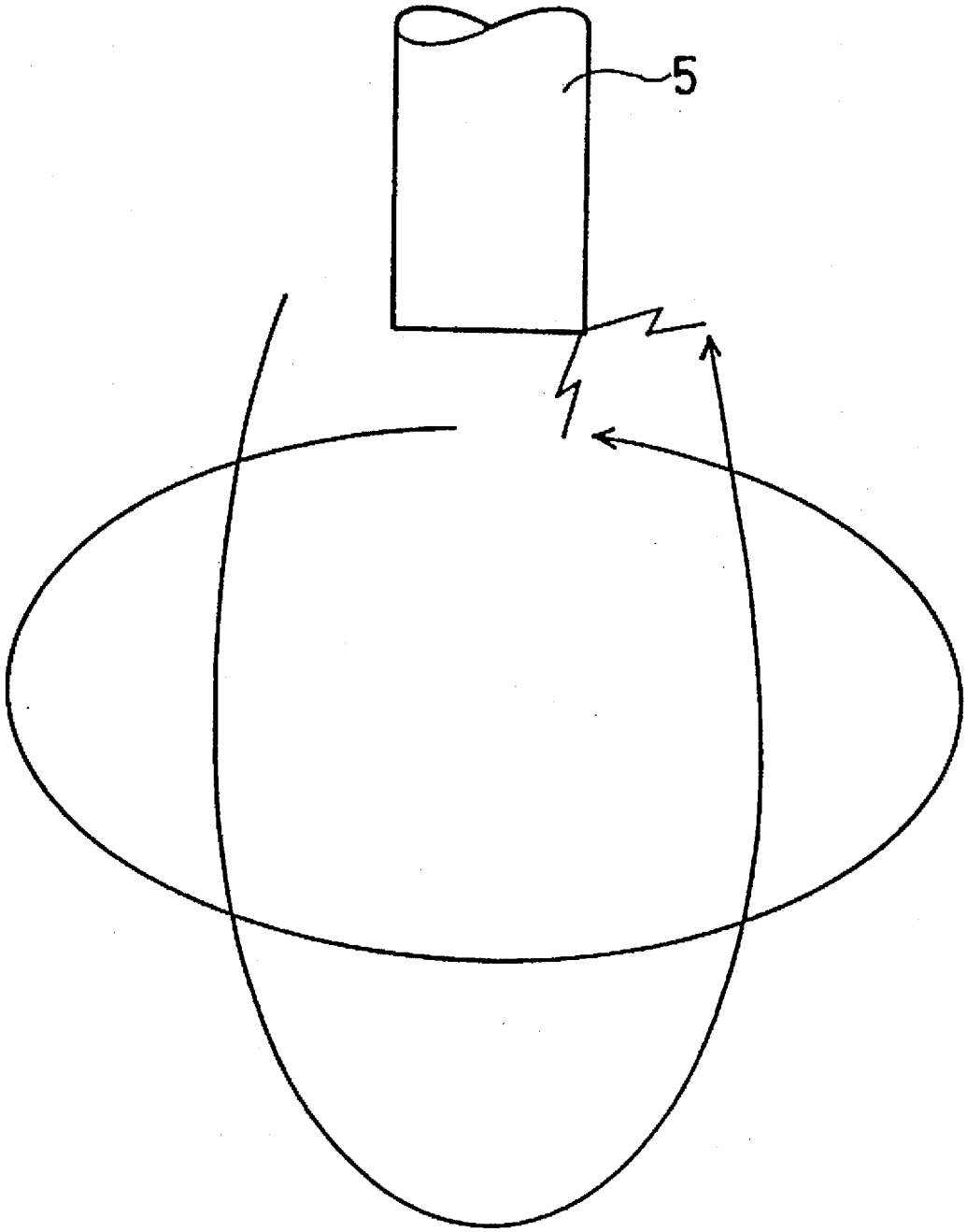
FIG. 9 is an explanatory view showing a swirl within a combustion chamber of an internal combustion engine.

This makes it possible to achieve a stable ignitability regardless of whether the swirl is oriented vertically or horizontally as shown in FIG. 9.

Figure 10:
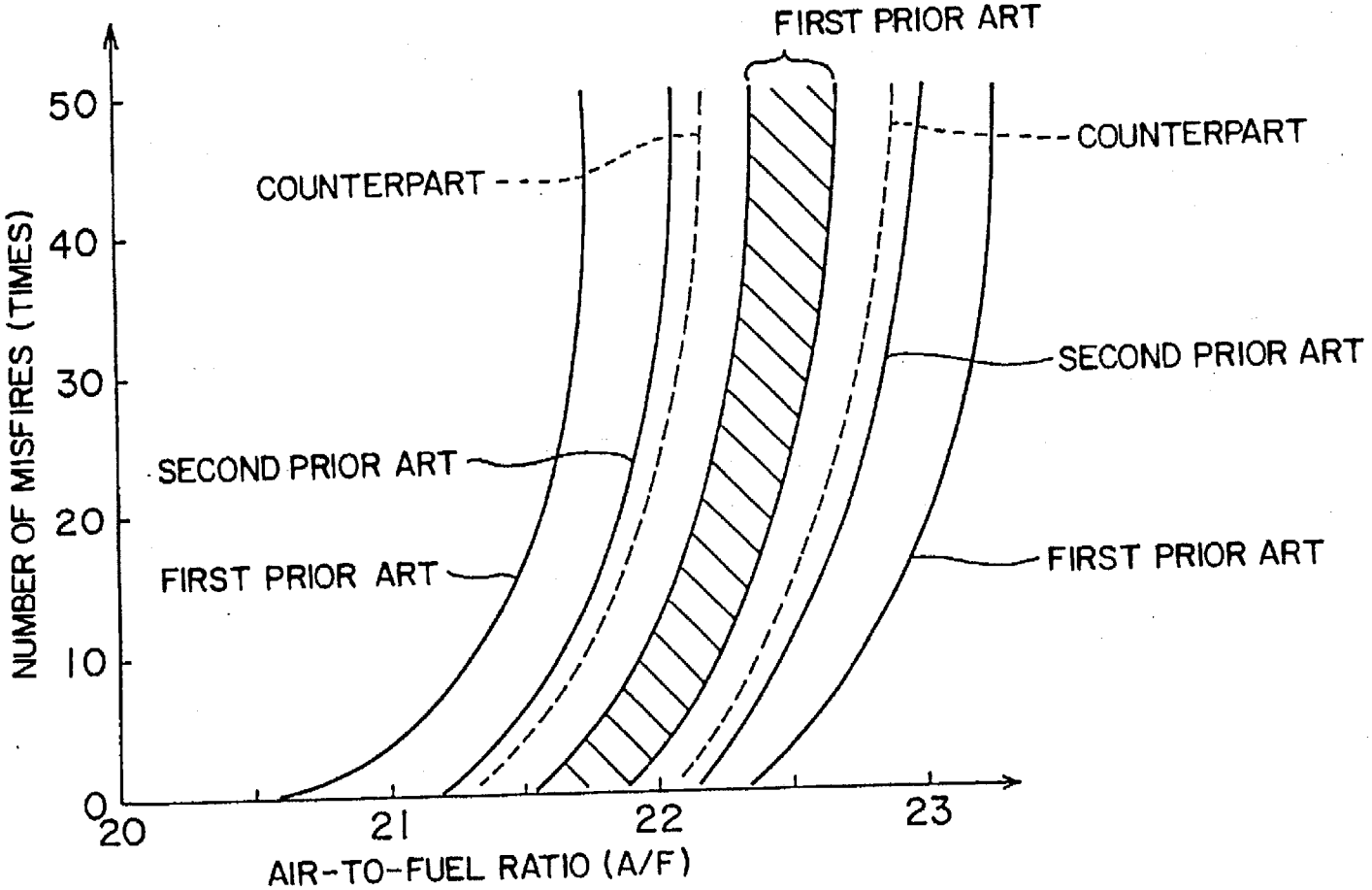
FIG. 10 is a graph showing a relationship between an air-to-fuel ratio (A/F) and number of misfires.

FIG. 10 shows a graph depicting how the number of misfires varies depending on the air-to-fuel ratio (A/F) in relation with the present invention, the first prior art (FIG. 17), the second prior art (Japanese Utility Publication No. 59-29358 in FIG. 18) and a counterpart (Japanese Patent Publication No. 52-15739).

As understood from the graph in FIG. 10, it is possible to achieve a stable ignitability with the least variation irrespective of the direction in which the first and second ground electrodes 6, 7 are oriented in the dual-polarity type spark plug 1 according to the first embodiment of the invention. In comparison with the first prior art, second prior art and the counterpart, this significantly reduces variation of the ignitability caused by the direction in which the first and second ground electrodes 6, 7 are oriented.

Figure 11:
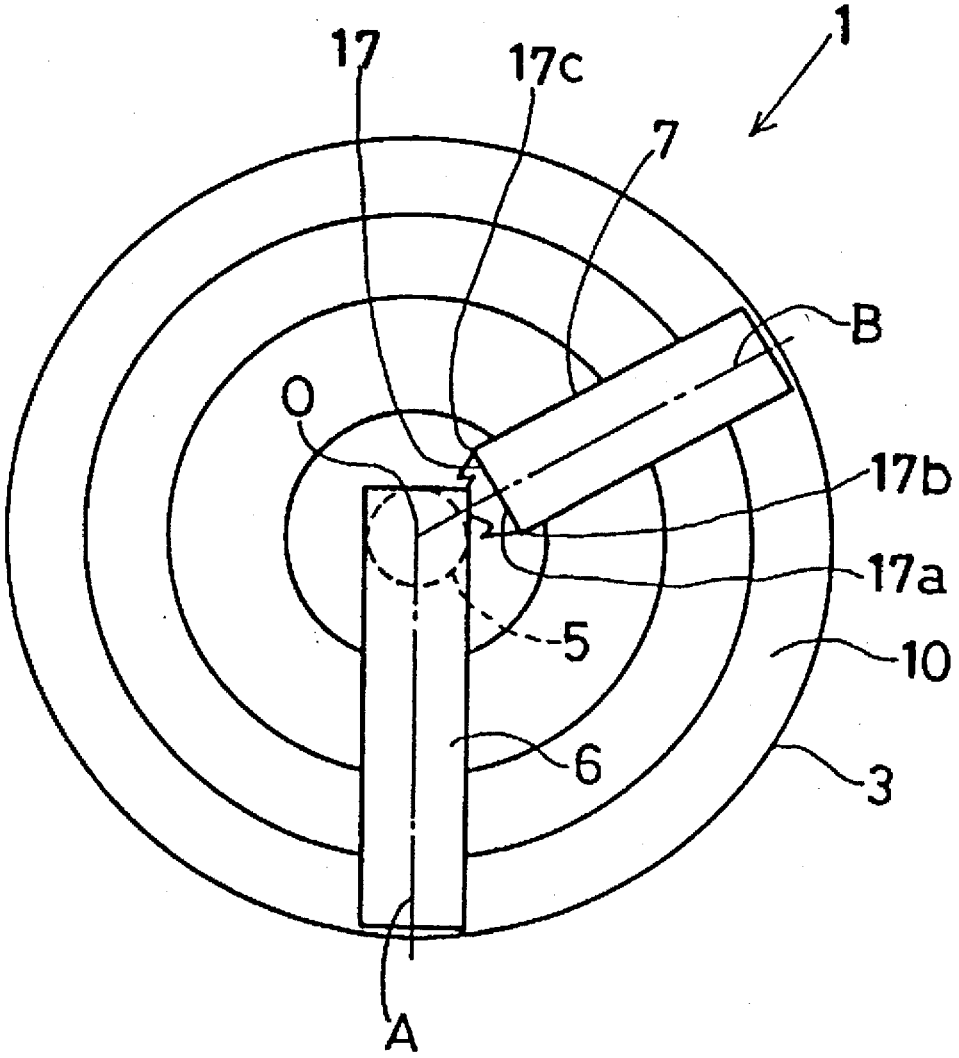
FIG. 11 is a plan view of a firing portion of a multi-polarity type spark plug according to a second embodiment of the invention.

FIG. 11 shows a second embodiment of the invention which depicts a prod-type spark plug of dual polarity mounted on an automotive gasoline engine. In the second embodiment of the invention, a flat-shaped configuration is provided on the firing end 17 of the second ground electrode 7 of the dual-polarity type spark plug 1 to serve as a flat surface 17*a*. By providing the flat surface 17*a* which opposes the elevational side 13 of the center electrode 5, it is possible to jump a spark from two edges 17*b*, 17*c* of the flat surface 17*a* to a middle portion of the elevational side 13 of the center electrode 5. This substantially enlarges an area of the spark gap to further improve the ignitability together with the advantage obtained by the first embodiment of the invention.

Figure 12:
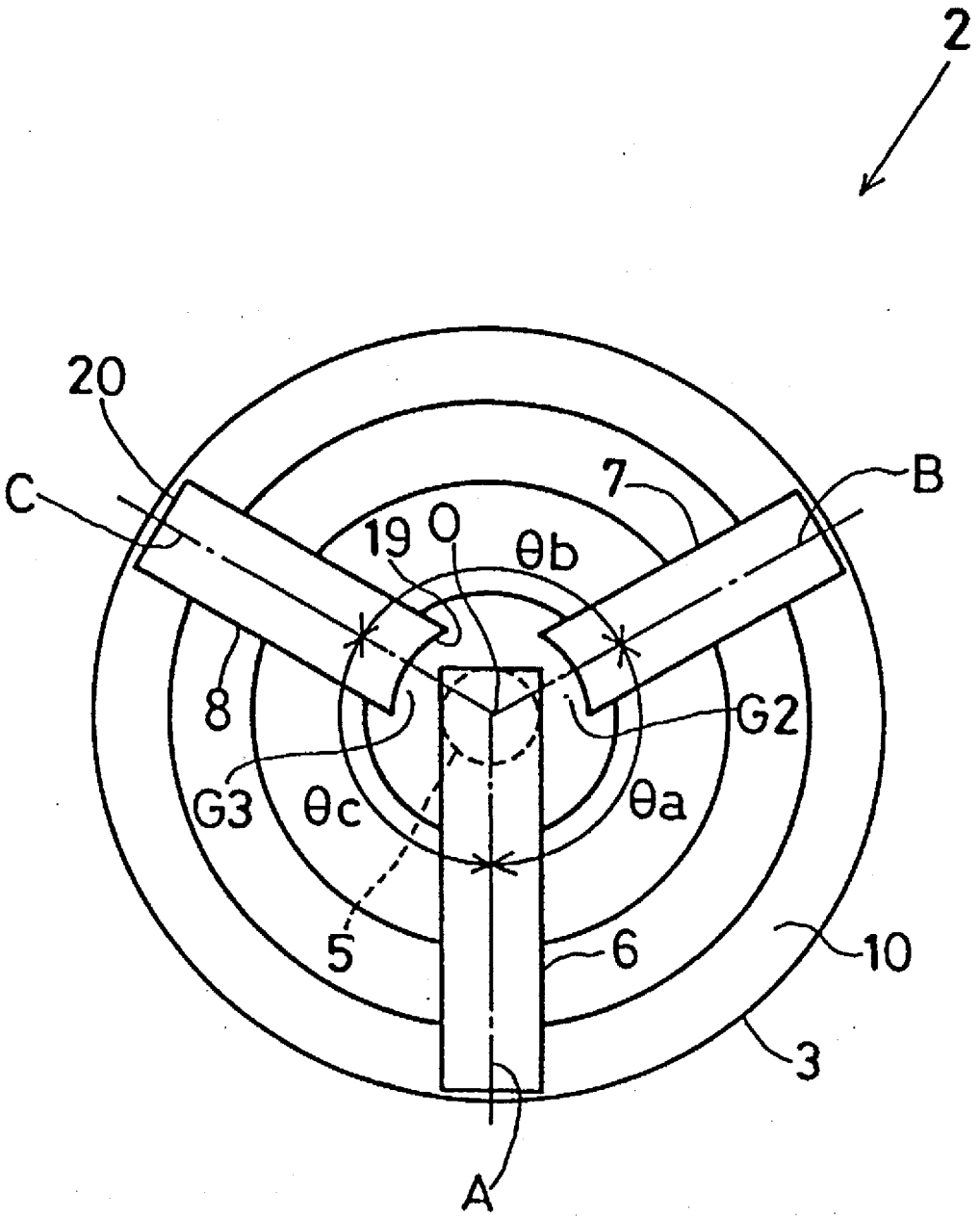
FIG. 12 is a plan view of a firing portion of a multi-polarity type spark plug according to a third embodiment of the invention.

Among FIGS. 12 through 15 which show a third embodiment of the invention, FIG. 12 depicts a prod type spark plug of tri-polarity mounted on an automotive gasoline engine.

In the third embodiment of the invention, a tri-polarity type spark plug 2 has a third ground electrode 8 which forms a third spark gap with the center electrode 5 in addition to the first and second ground electrodes 6, 7. The third ground electrode 8 is made of the same electrically conductive metal as the first and second ground electrodes 6, 7. The third ground electrode 8 has a firing end 19 in opposite with the elevational side 13 of the center electrode 5, and having a connection end 20 connected to the front end 10 of the metallic shell 3.

Between the firing end 19 of the third ground electrode 8 and the elevational side 13 of the center electrode 5, a third spark gap G3 is provided. Across the third spark gap G3, a third spark discharge path H3 is formed in a direction from the elevational side 13 of the center electrode 5 to the firing end 19 of the third ground electrode 8. The third spark discharge path H3 is oriented in the radial direction (laterally or horizontally) of the center electrode 5.

In the first, second and third ground electrodes 6, 7 and 8, an angular relationship among θa, θb and θc is defined as follows:

$$60° \leqq \theta a \leqq 150°,$$

$$60° \leqq \theta b \leqq 150°,$$

$$60° \leqq \theta c \leqq 150° \text{ and}$$

$$\theta a + \theta b + \theta c = 360°.$$

Where θa is an angle in which the second ground electrode 7 makes with the first ground electrode 6 with the center electrode 5 as an axial center, θb is an angle in which the third ground electrode 8 makes with the second ground electrode 7 with the center electrode 5 as an axial center, θc is an angle in which the first ground electrode 6 makes with the third ground electrode 8 with the center electrode 5 as an axial center.

In more concrete terms, the angle θa (<AOB) is formed at the intersection in which the phantom line A meets the phantom line B. The phantom line A is shown by connecting the central line of the first ground electrode 6 to the axial line of the center electrode 5 as shown in FIG. 12. The phantom line B is shown by connecting the central line of the second ground electrode 7 to the axial line of the center electrode 5.

The angle θb (<BOC) is formed at the intersection in which the phantom line B meets a phantom line C. The phantom line C is shown by connecting the central line of the third ground electrode 8 to the axial line of the center electrode 5.

The angle θc (<COA) is formed at the intersection in which the phantom line A meets the phantom line C. Around the center electrode 5 with regular intervals (120°), these first, second and third ground electrode 7 and 8 are connected to the front end 10 of the metallic shell 3 by means of electric resistance welding or the like.

Figure 16:
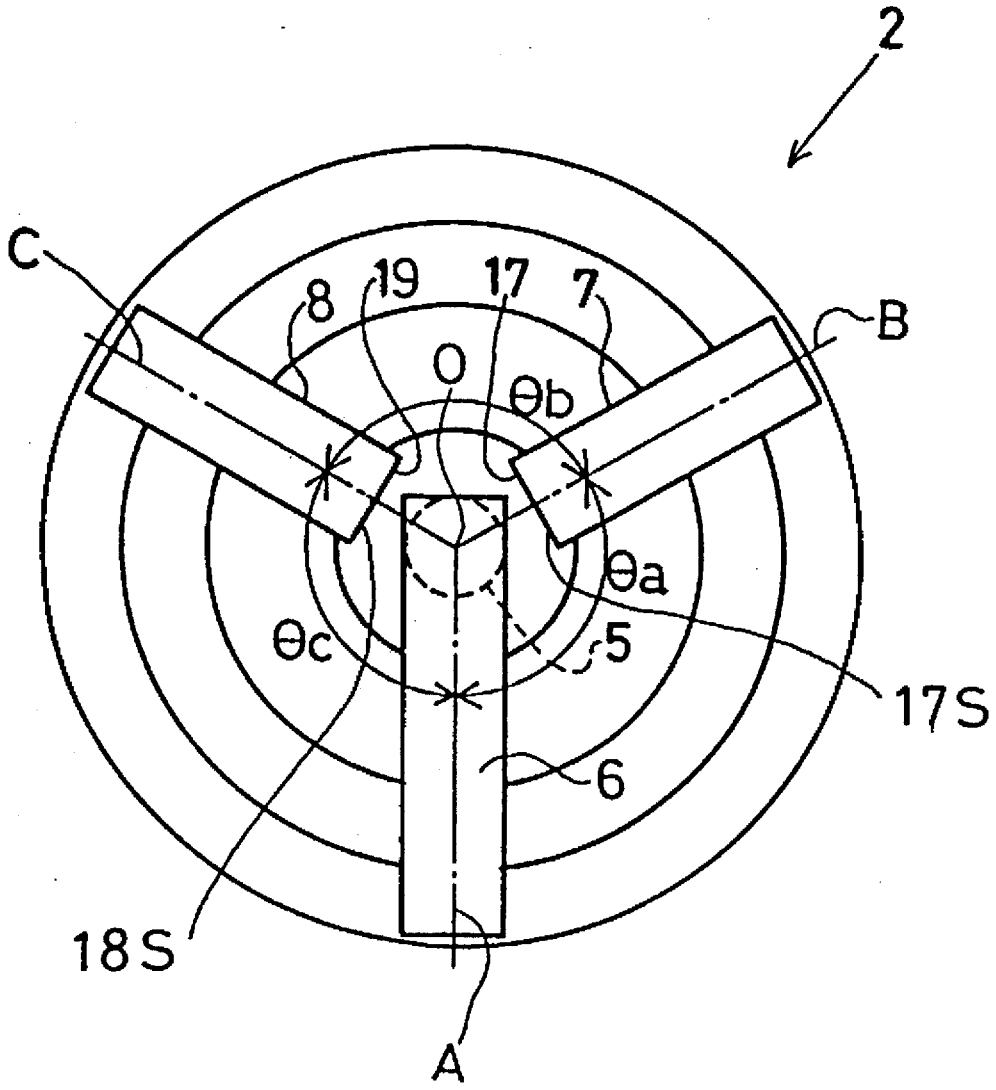
FIG. 16 is a plan view of a firing portion of a multi-polarity type spark plug according to a fourth embodiment of the invention.
Figure 17A:
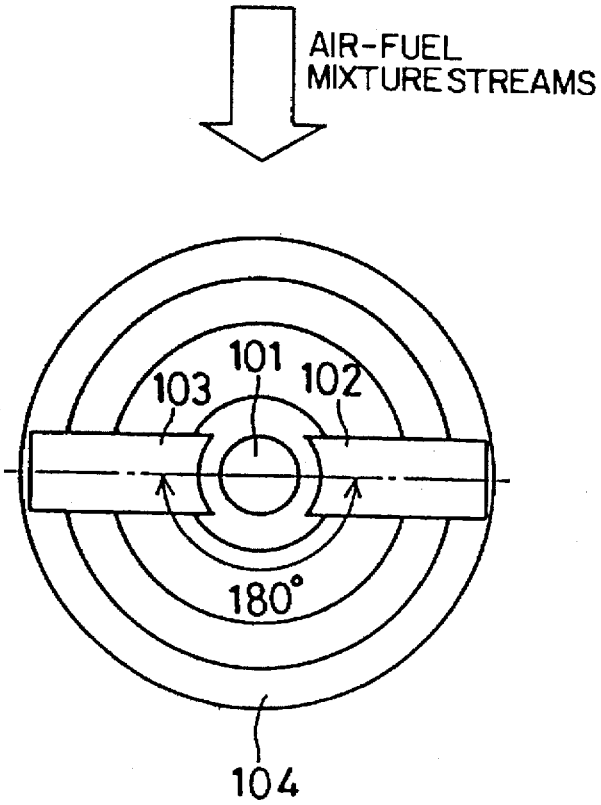
Fig.17a PRIOR ART
FIGS. 17*a* and 17*b* are plan views of a first prior art spark plug.
Figure 17B:
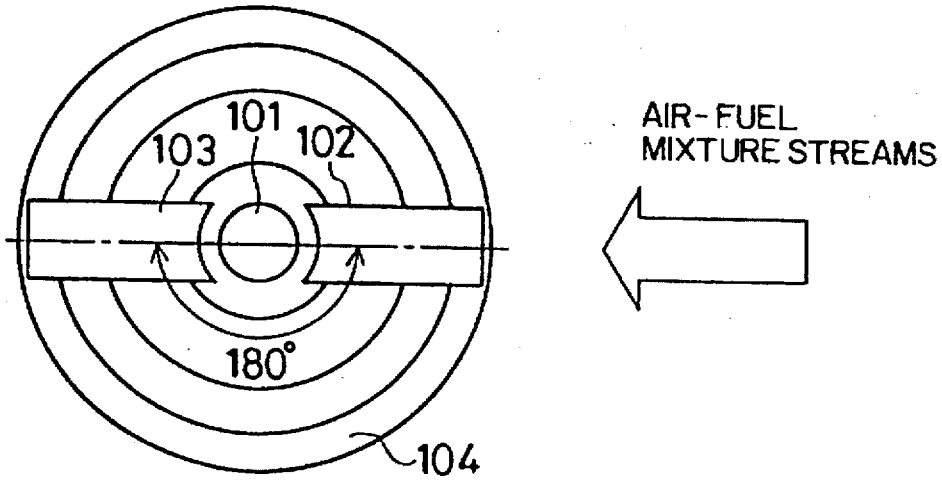
Fig.17b PRIOR ART
Figure 18:
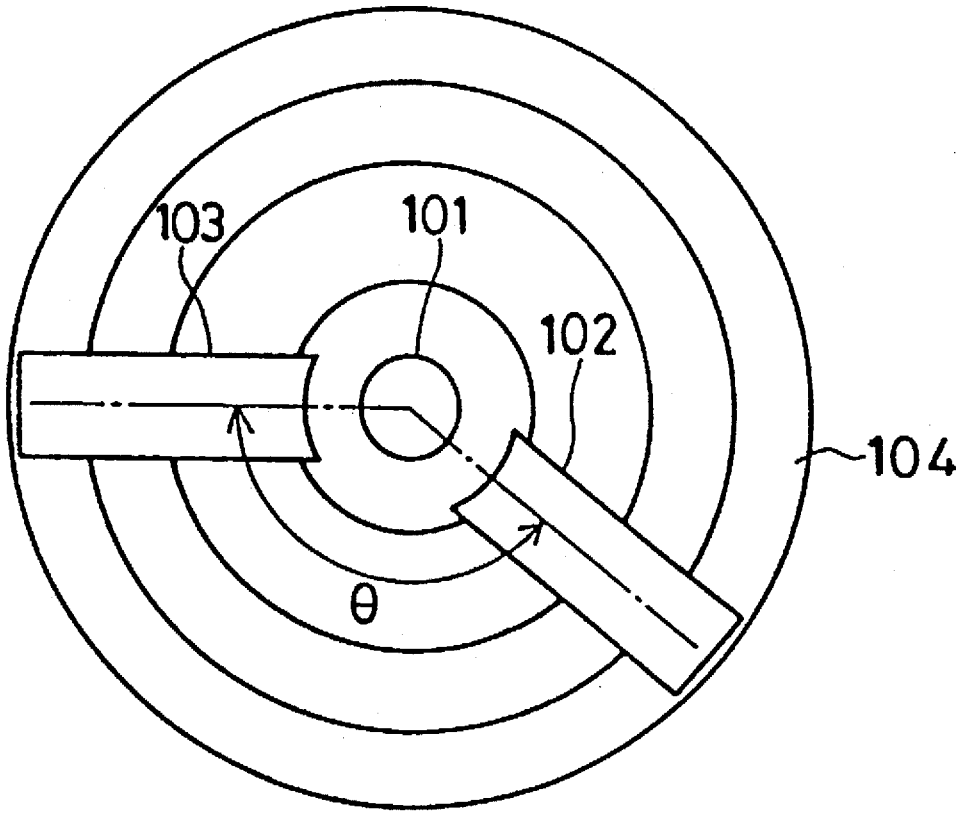
Fig. 18 PRIOR ART
FIG. 18 is a plan views of a second prior art spark plug.
Figure 19:
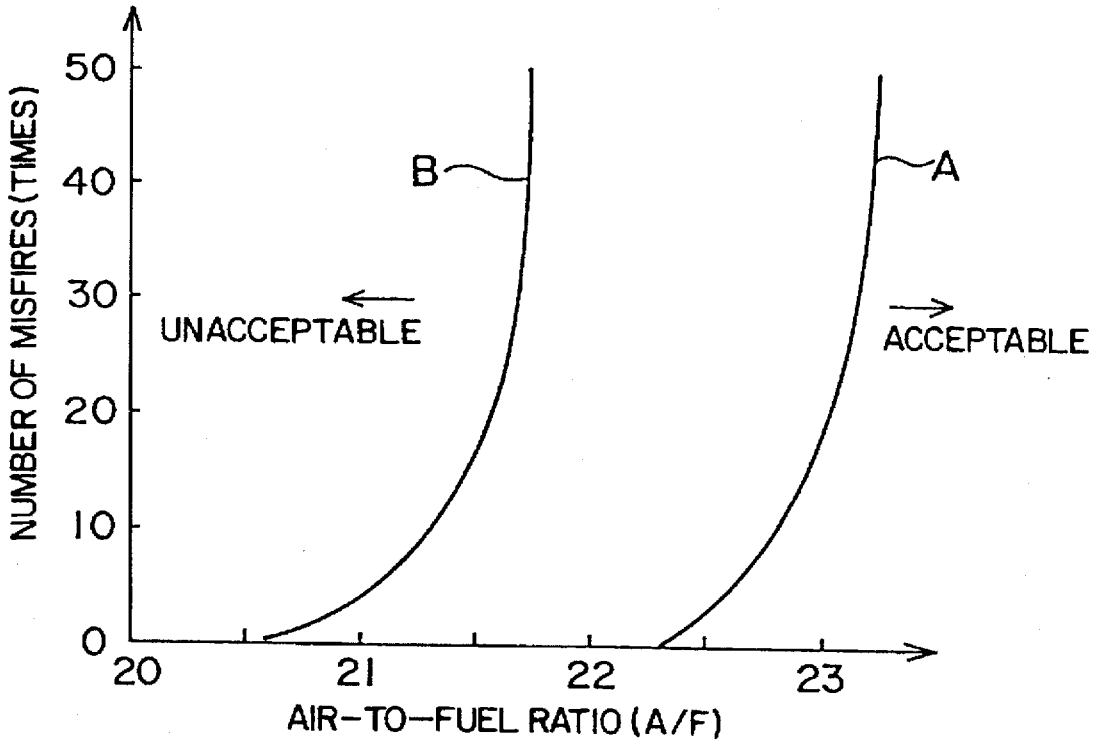
Fig. 19 PRIOR ART
FIG. 19 is a graph showing a relationship between an air-to-fuel ratio and number of misfires in the first prior art spark plug.
Figure 20:
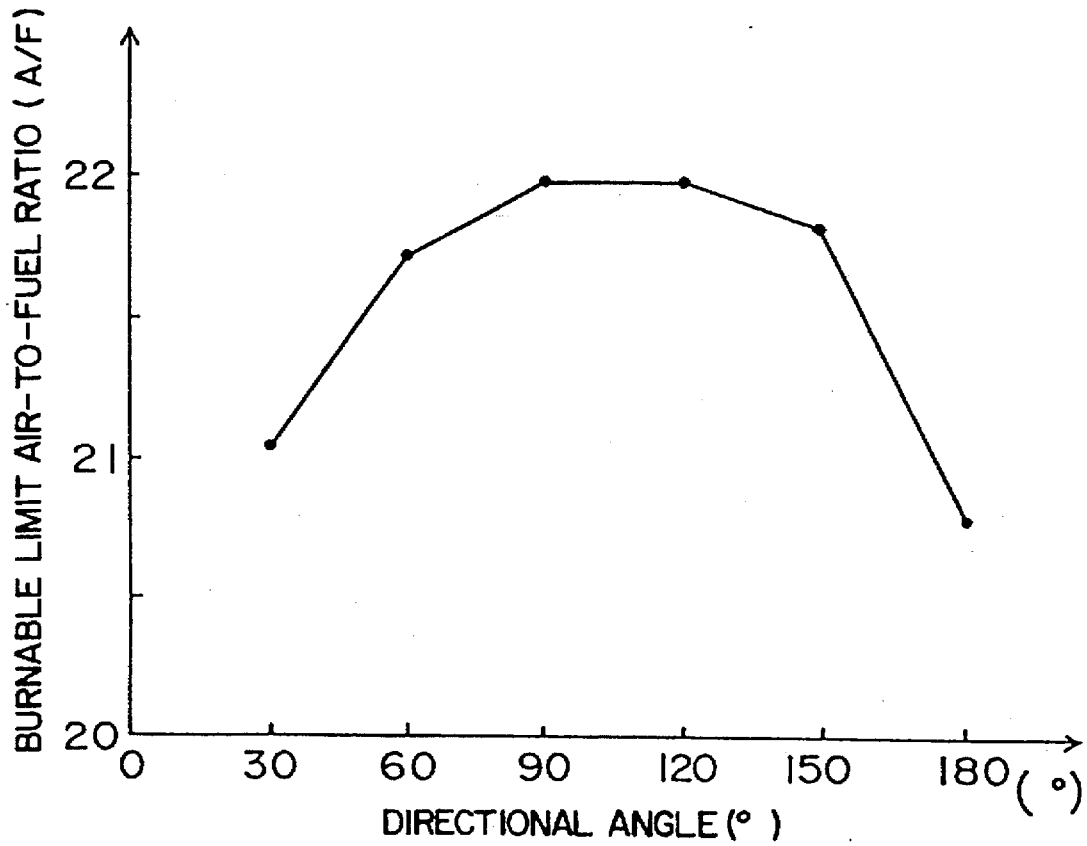
Fig. 20 PRIOR ART
FIG. 20 is a graph showing how a burnable limit air-to-fuel ratio (A/F) changes depending on a directional angle in which one ground electrode forms with the other ground electrode.

Experimental tests were carried out to check how ignitability is affected by changing directions of the first and second ground electrodes 6, 7 with the axis of the center electrode 5 as a central portion. Upon carrying out these experimental tests, minutiae of the multi-polarity type spark plug is defined as follows:

A diameter of the center electrode 5 measures 2.5 mm, the spark gaps measures 1.0 mm between the center electrode 5 and the first, second and third ground electrodes 6, 7, 8. The extension length of the center electrode 5 measures 3.0 mm, and the dimension of the first, second and third ground electrodes 6, 7, 8 is 1.3 mm×2.2 mm (FIGS. 16,17).

Upon carrying out first, second and third experimental tests, a burnable limit air-to-fuel ratio is checked by running 70 km with the tri-polarity type spark plug 2 (FIG. 12) mounted on a 6-cylinder, 2000 cc, lean burn gasoline engine.

Figure 13A:
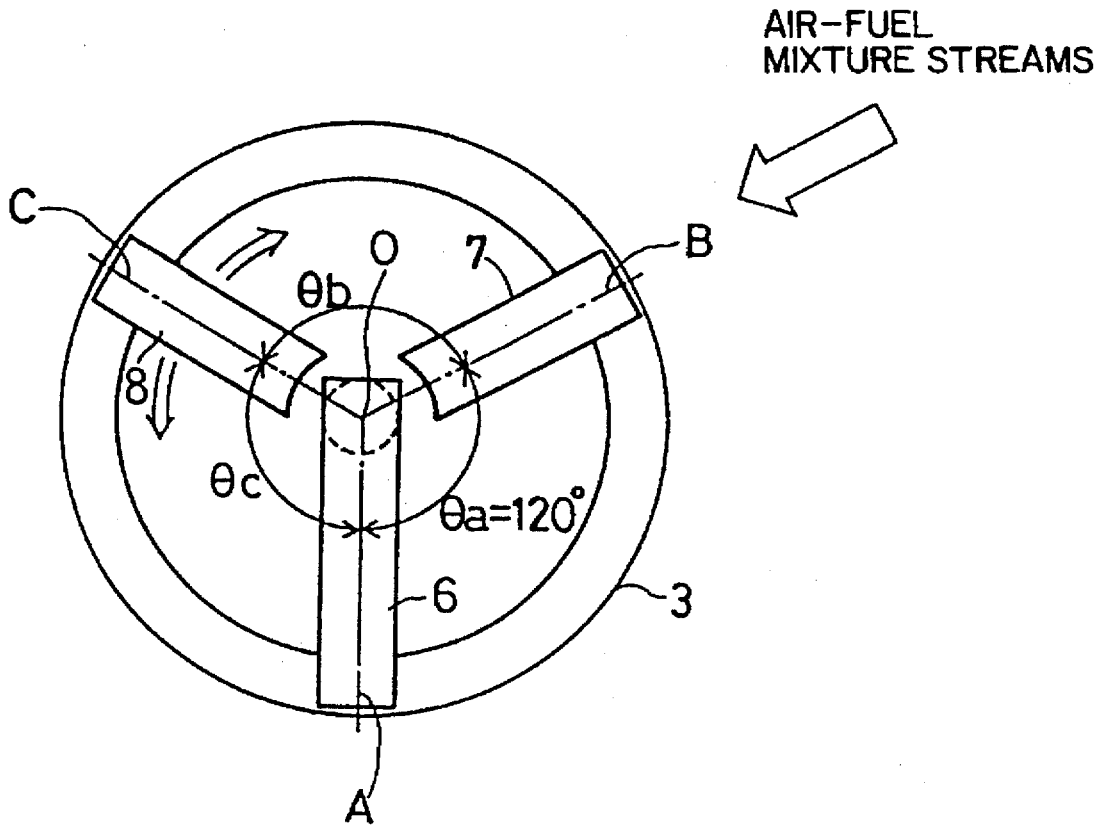
FIG. 13*a* is an explanatory view showing a relationship between an air-fuel mixture streams and directions of first through third ground electrode in the first experimental test.
Figure 13B:
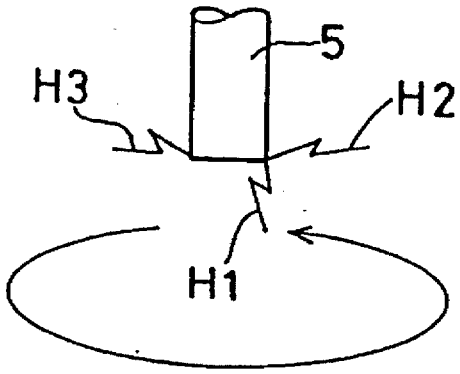
FIG. 13*b* is an explanatory view showing the air-fuel mixture streams within a combustion chamber of an internal combustion engine in the first experimental test.

In the first experimental test, the second ground electrode 7 is oriented such as to worsen the ignitability in relation with the air-fuel streams running horizontally as already shown in FIGS. 13*a* and 13*b*. In this situation, the ignitable limit air-to-fuel ratio (A/F) was checked by changing the directional angle (θb) in which the third ground electrode 8 forms with the second ground electrode 7 from 30° to 150° while keeping the angle (θb) at 120°. The results are shown in FIG. 14.

Figure 14:
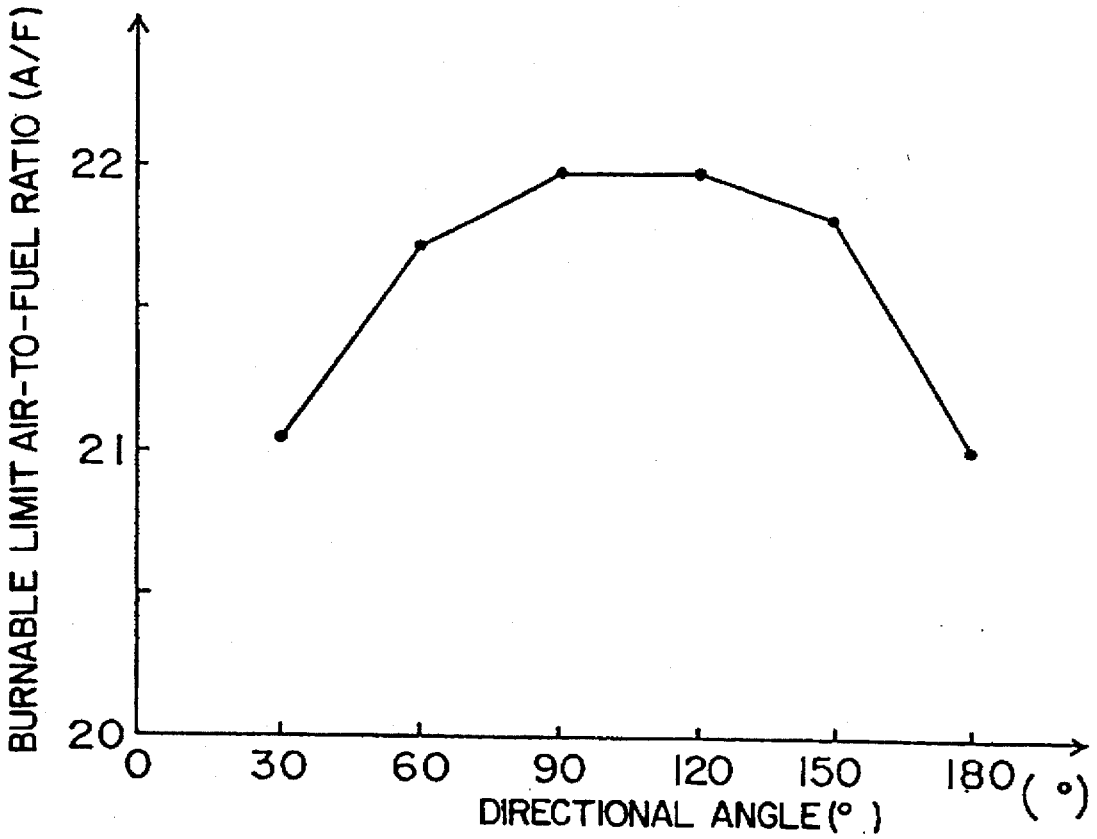
FIG. 14 is a graph showing a relationship between a burnable limit air-to-fuel ratio (A/F) and an angle in which the first ground electrode forms with the second ground electrode in the first experimental test.

As confirmed by FIG. 14, the ignitability tends to abruptly worsen when the third ground electrode 8 nears the second ground electrode 7 so that the angle (θa) is less than 60°. The ignitability also tends to abruptly worsen when the third ground electrode 8 nears the first ground electrode 6 so that the angle (θb) exceeds 150° which means that the angle (θc) is less than 60°. To summarize the results, the ignitability tends to be significantly improved when the directional angle (θa) is from 60° to 150°, and the ignitability is preferably improved particulary when the directional angle (θa) ranges from 90° to 120°.

Figure 15A:
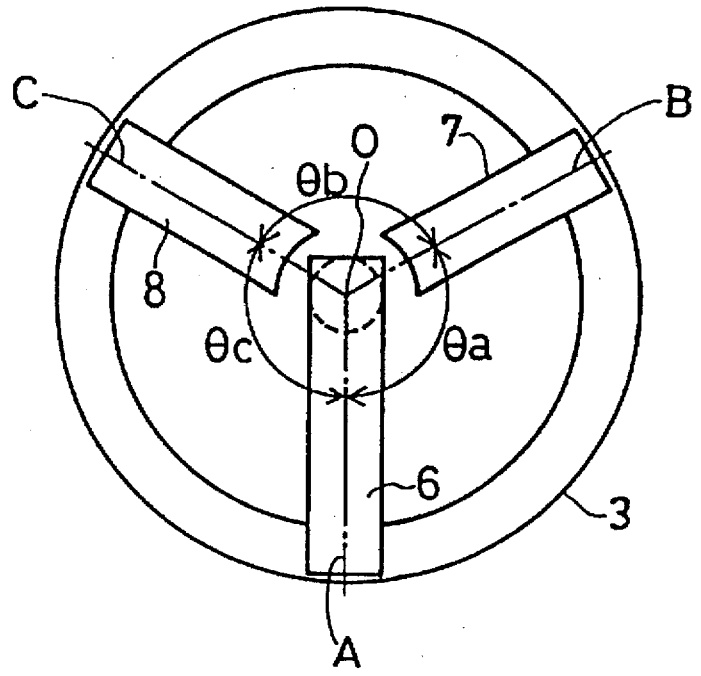
FIG. 15*a* is an explanatory view showing a relationship between an air-fuel mixture streams and directions of first through third ground electrode in the second experimental test.
Figure 15B:
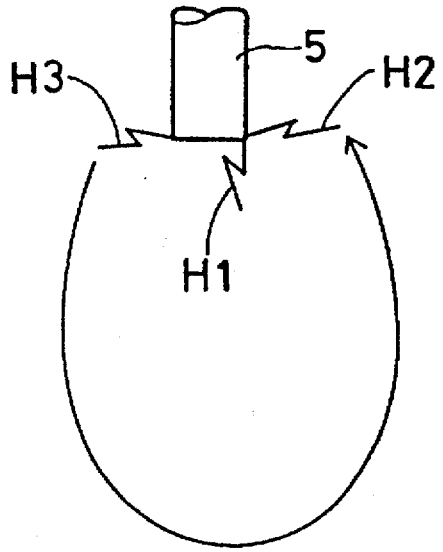
FIG. 15*b* is an explanatory view showing the air-fuel mixture streams within a combustion chamber of an internal combustion engine in the second experimental test.

In the second experimental test, the first ground electrode 6 is oriented such as to worsen the ignitability in relation with the air-fuel streams running vertically as already shown in FIGS. 15*a* and 15*b*. In this situation, the ignitable limit air-to-fuel ratio (A/F) was checked by changing the directional angle (θa) in which the second ground electrode 7 forms with the first ground electrode 6 from 30° to 180° while keeping the angle (θc) at 120°. The results are substantially the same as obtained by FIG. 14.

In a second experimental test, it was carried out to check how the number of misfires varies depending on the air-to-fuel ratio (A/F) in relation with the present invention, the first prior art (FIG. 17), the second prior art (Japanese Utility Publication No. 59-29358 in FIG. 18) and a counterpart (Japanese Patent Publication No. 52-15739).

With the result of the second experimental test, it is found that the ignitability was improved in the same manner as the first embodiment of the invention indicated by the graph in FIG. 10.

Referring to FIG. 16 which shows a firing portion of the tri-polarity type spark plug 2 according to the fourth embodiment of the invention, the firing ends 17, 19 of the second and third ground electrodes 7, 8 are formed into a flat-shaped configuration. With the flat-shaped configuration provided as flat surfaces 17*s*, 18*s*, the ignitability is improved in the same degree as the second embodiment of the invention.

It is observed that a noble metal tip may be provided, as a firing end, at least on one of the center electrode 5, the first, second and third ground electrodes 6, 7, 8 in the dual-polarity, tri-polarity type of spark plugs 1, 2. With the noble metal tip provided as a firing end which forms the spark gap with the corresponding electrode, it is possible to further improve a spark-erosion resistance so as to contribute to an extended service life.

While the invention has been described with reference to the specific embodiments, it is understood that this description is not to be construed in a limiting sense in as much as various modifications and additions to the specific embodiments may be made by skilled artisans without departing from the spirit and scope of the invention.

What is claimed is:

1. In a multi-polarity type spark plug for an internal combustion engine comprising:

a tubular insulator supported within a cylindrical metallic shell through which a spark plug is to be attached to an internal combustion engine;

a center electrode placed within the insulator, a front end of the center electrode being directed toward a combustion chamber of the internal combustion engine from a front end of the metallic shell so as to extend beyond a front end of the insulator;

a first ground electrode connected to the front end of the metallic shell, and having a front end surface opposing the front end surface of said center electrode, the first ground electrode forming a first vertical spark gap with the front end surface of the center electrode;

a second ground electrode connected to the front end of the metallic shell, and having a front end surface which directly opposes an elevational side of the center electrode and forms a second horizontal spark gap therebetween;

an angle θa being limited as follows:

$$60° \leqq \theta a \leqq 150°$$

wherein θa is an angle in which the first ground electrode forms against the second ground electrode with the center electrode as an axial center.

2. In the multi-polarity type spark plug for an internal combustion engine as recited in claim 1, wherein the front end surface of the second ground electrode serves as a firing portion which forms the second horizontal spark gap with the elevational side of the center electrode, said front end surface which is a flat-shaped configuration.

3. In the multi-polarity type spark plug for an internal combustion engine as recited in claim 1 further comprising a third ground electrode whose front end surface directly opposes the elevational side of the center electrode and forms a third horizontal spark gap therebetween, and an angular relationship among θa, θb, and θc is limited as follows:

$$60° \leqq \theta a \leqq 150°,$$

$$60° \leqq \theta b \leqq 150°,$$

$$60° \leqq \theta c \leqq 150°,$$

$$\theta a + \theta b + \theta c = 360°,$$

wherein θb is an angle in which the second ground electrode forms against the third ground electrode with the center electrode as an axial center, wherein θc is an angle in which the third ground electrode forms against the first ground electrode with the center electrode as an axial center.

4. In the multi-polarity type spark plug for an internal combustion engine as recited in claim 3, wherein the front end surfaces of both the second and third ground electrodes serve as a firing portion which forms the second and third horizontal spark gaps with the elevational sides of the center electrode, said front end surfaces which are a flat-shaped configuration.

* * * * *